US007059843B1

(12) United States Patent
Badgley

(10) Patent No.: US 7,059,843 B1
(45) Date of Patent: Jun. 13, 2006

(54) SPLIT VANE FOR AXIAL VANE ROTARY DEVICE

(75) Inventor: Patrick Badgley, Columbus, IN (US)

(73) Assignee: Advanced Technologies, Inc., Starkville, MS (US)

( * ) Notice: Subject to any disclaimer, the term of this patent is extended or adjusted under 35 U.S.C. 154(b) by 0 days.

(21) Appl. No.: 10/890,792

(22) Filed: Jul. 14, 2004

Related U.S. Application Data

(62) Division of application No. 10/679,846, filed on Oct. 6, 2003, now abandoned.

(51) Int. Cl.
*F04C 2/00* (2006.01)

(52) U.S. Cl. ..... 418/219; 418/258; 418/148

(58) Field of Classification Search ..... 418/219, 418/231, 258, 136, 137, 146–148
See application file for complete search history.

(56) References Cited

U.S. PATENT DOCUMENTS 1,940,384 A * 12/1933 Zoller ..... 418/254
2,154,458 A * 4/1939 Knapp ..... 418/219
3,437,079 A * 4/1969 Odawara ..... 418/111
4,439,117 A * 3/1984 Bunger ..... 418/219
5,224,850 A * 7/1993 Pie ..... 418/148

FOREIGN PATENT DOCUMENTS

FR 1315068 A * 1/1963 ..... 418/219

* cited by examiner

*Primary Examiner*—Theresa Trieu
(74) *Attorney, Agent, or Firm*—Stites & Harbison PLLC; John E. Vanderburgh

(57) ABSTRACT

An improved vane for axial vane rotary devices such as pumps, compressors and expanders comprising at a pair of axially movable inner housing seal pieces defining and upper camming surface and a lower edge. The vanes are provided with spaces for receiving the seal pieces and the spaces have at least one edge corresponding to the camming surface of the seal piece. In one embodiment a median portion of a single piece vane is cut away to define a space in which the seal pieces are received. In another embodiment the vane is divided into two axially slidable sections and a corner portion of each section is cut away to provide a space for receiving a seal piece. During operation the seal pieces are cammed radially downward during axial movement to bring the lower edge of the seal piece into contact with the inner housing of the device rotor to improve sealing and reduce leakage of pressurized fluid between the vane and the inner housing.

8 Claims, 2 Drawing Sheets

SPLIT VANE FOR AXIAL VANE ROTARY DEVICE

REFERENCE TO RELATED APPLICATIONS

This application is a divisional application of application Ser. No. 10/679,846, entitled SPLIT VANE FOR AXIAL ROTARY DEVICE, filed Oct. 6, 2003 now abandoned in the name of Patrick Badgley.

FIELD OF THE INVENTION

The invention relates to axial vane rotary devices and more particularly to a novel vane configuration for axial vane rotary pumps, compressors, engines and expanders.

BACKGROUND OF THE INVENTION

Many different types of rotary devices have been suggested in the past and have been covered by a large number of patents. Only a relatively small number of these have been thoroughly tested. Many rotary devices such as engines are of interest on paper, but practical difficulties arise when prototypes are constructed. In the field of rotary engines, the best known is the Wankel engine that has been in volume production in Mazda automobiles. Even this engine has had considerable difficulties with proper sealing of the rotors, although such problems have been large overcome.

Another type of rotary engine is referred to herein as the "axial vane type". This type of engine has a cylindrical rotor located within the cylindrical chamber in a stator. A plurality of blade-like vanes extends slideably through the rotor, parallel to the axis of rotation. There are undulating, parallel cam surfaces on each side of the rotor. High portions of the cam surface on one side align with low portions of the cam surface on the other side.

Rotary engines and other rotary devices such as pumps, compressors and expanders, for example, offer many potential advantages including high efficiency, simple construction and lightweight. However, while the theoretical possibilities of such devices have been suggested in the past, many practical difficulties have inhibited their development beyond the stage of the working prototype. As mentioned above, axial vane rotary devices typically employ solid, generally rectangularly shaped vanes that axially slide on the rotor in response to urging by undulating cam surfaces formed on the end walls of the housing that contains the rotor. The cam surfaces are opposed in that high points on the cam surface on one side of the housing are opposed to low point on the cam surface of the opposite end wall. Only one of the outer edges of the vanes will normally contact a cam surface at a time while the opposite edge is spaced slightly from the cam surface thus providing a gap for leakage of compressed fluid. Likewise during operation, centrifugal force may cause the vanes to lift creating a gap between the inner edges of the vanes and the stationary inner housing in which the rotor drive shaft is housed. Some earlier publications fail to disclose any practical system of seals between the rotor, vanes and stator. In the absence of good sealing the efficiency of the rotary devices is substantially reduced especially in the case of pumps, expanders and compressors.

In an attempt to overcome the sealing problems encountered in axial vane rotary devices some designs of such devices includes the vanes that further include spring members to normally urge the vanes are. Examples of such devices are found in U.S. Pat. No. 22,955, granted Feb. 15, 1859 and U.S. Pat. No. 3,489,126, granted Jan. 13, 1970. Despite these designs, leakage continues to be a problem, particularly between the inner edge of a vane and the inner housing of the rotor in which the rotor drive shaft is contained.

Some of the leakage problems caused by poor sealing have been overcome by an improved axial vane device as described in U.S. Pat. Nos. 5,509,793, 5,551,853 and 5,429,084 to Cherry, et al. The axial vane devices of the type described in these patents are used as pumps, expanders and compressors.

However, sealing the axial vanes in an axial vane rotary device adds substantially to the complexity and cost of manufacture and can result in high maintenance costs. Accordingly, it would be highly desirable to provide a vane design for an axial vane rotary device that provides improved sealing and device efficiency while allowing for the reduction of the complexity and number of seals required and resulting reduction of manufacturing cost.

SUMMARY OF THE INVENTION

The present invention relates to an improved vane for axial vane rotary devices such as pumps, compressors and expanders. The improved vane reduces leakage of compressed fluid around the edges of the vanes by creating contact between the cam surfaces of both ends of the housing and both edges of the vanes.

In accordance with one aspect of the invention an improved vane comprises at least two sections, each section defining a radially outer end, a radially inner end, a cam follower edge for contact with a cam surface on an end wall of the device housing and an opposite edge. The opposite edge of one section of the vane faces the opposite edge of the other section and each section is axially movable on the rotor of the rotary device independently of the other section. A portion of each vane section adjacent the radially inner end and the opposite edge is separated from the vane section to define a seal piece including a camming surface that upon axial of the seal piece produces a radially downward movement to load the inner end of the separated seal piece against the inner housing of the device to aid in forming a seal between the radially inner end of the vane sections and the inner housing of the device.

In another aspect of the invention, the improved vane of the invention is a single piece that is adapted to receive a pair of oppositely, axially, radially downwardly movable seal pieces. Each seal piece defines a camming surface and a lower edge that forms a seal with the inner housing when the seal piece is moved downwardly in response to the camming action produced by the axial movement of the seal pieces.

Although not critical, as an aid in bringing the cam follower edges of each vane section into contact with the cam surface of the respective end walls, at least one spring is disposed between the opposite edges of the sections of a vane. The spring serves to urge the sections axially apart to load the cam follower edges of the sections against their respective cam surface even when the device is not operational. A spring member may advantageously be disposed between pairs of seal pieces to urge them axially apart.

Fluids that are compressed during operation of the device act against the opposite edges of the seal pieces forcing them axially apart to produce a radially downward movement of the seal pieces as a result of contact between the camming surface of each piece and a corresponding edge of the vane that loads the inner edge of the seal pieces against the inner housing of the rotor to maintain a seal therebetween.

DESCRIPTION OF THE INVENTION

Figure 1:
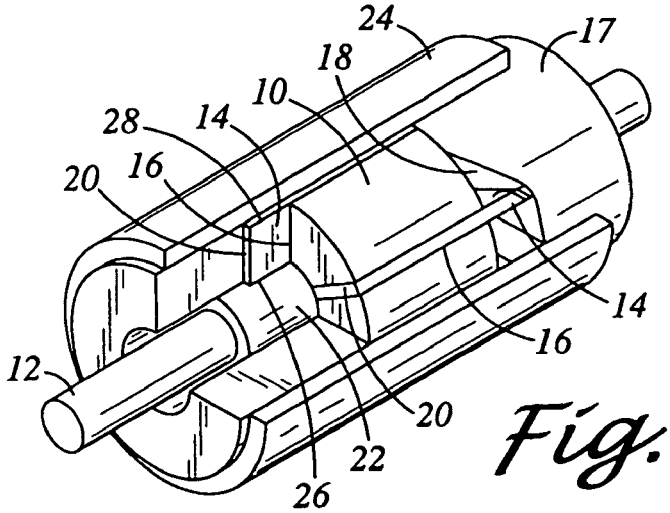
FIG. 1 is a perspective view partially broken away of a simplified axial vane rotary device.

Referring to FIG. 1, a simplified version of an axial vane rotary device is illustrated. The axial vane rotary device basically comprises a cylindrical rotor 10 and an integral shaft 12 and a quantity of vanes 14 axially movable in slots 16 in the periphery of the rotor. The inwardly facing surfaces of end walls 17 define face cams 18 that act on each of the edges 20 of the vanes 14 adjacent to the cam faces to axially move the vanes as the rotor rotates. A fixed inner housing 22, in which is disposed the shaft 12, and a fixed outer housing 24 contain the inner ends 26 and the outer ends 28 of the vanes 14. The rotational speed of the rotor 10 coupled with the force of the pressurized fluid can lift the vanes 14 against the inner surface of the outer housing 24 creating a small gap between the radially inner end of the vanes 14 and the inner housing 22. Accordingly, during rotation, leakage between the rotor 10 and the inner housing 22 requires sealing elements to control the leakage. These seals are difficult to make and install and add to the manufacturing and the maintenance costs of the axial vane devices. Also during rotation the edges 20 of the solid vanes 14, which should be contiguous with the face cams 18 of both of the end walls 17, tend to engage at one edge while there is a slight gap at the opposite edge that allows leakage of pressurized fluid and the resultant loss of device efficiency.

Figure 2:
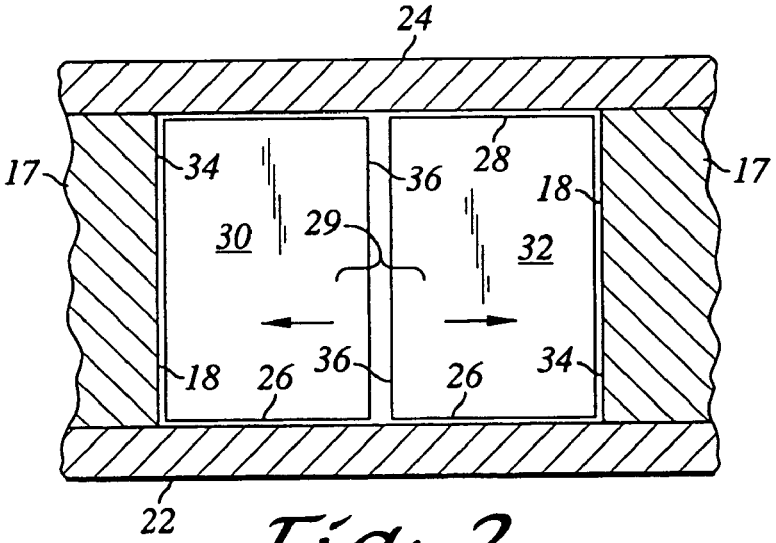
FIG. 2 is a side view of a split vane in accordance with the invention.
Figure 3:
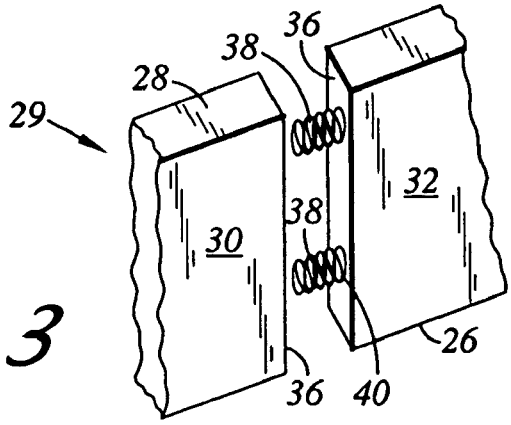
FIG. 3 is a perspective view broken away for compactness of illustration of another embodiment of the split vane.
Figure 4:
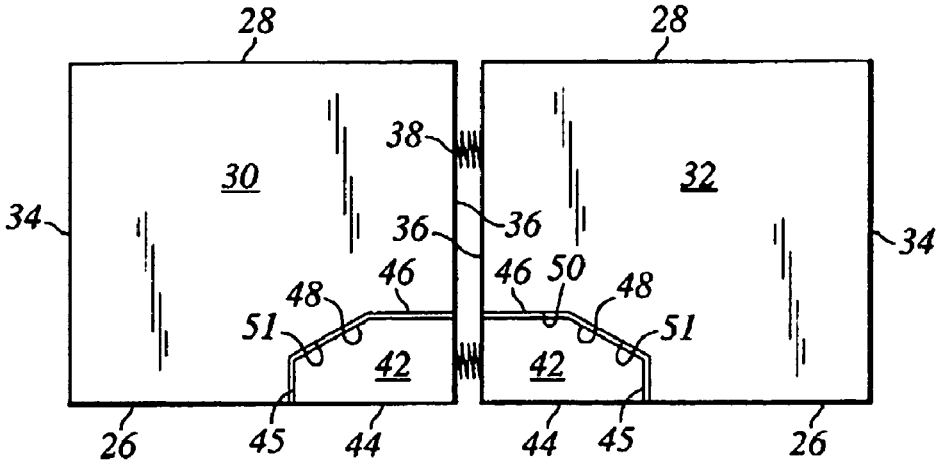
FIG. 4 is perspective view of another embodiment of the invention illustrating a split vane with an inner housing seal piece in each vane showing one inner housing seal piece in an extended position.

Referring to FIGS. 2, 3 and 4, a vane 29 designed in accordance with the invention is divided into two sections 30 and 32. Each of the sections 30 and 32 are mirror images and each includes a radially inner end 26, a radially outer end 28, a cam follower edge 34 and an opposite edge 36. Section 30 is free to move axially independently of section 32 and vice versa.

During operation of an axial vane rotary device that is provided with the split vanes 29 of the invention, pressurized fluid formed between the vanes 14 during the compression cycle between the opposite ends of the sections 30 and 32 penetrates between the opposite edges 36 of the sections and acts to urge the sections axially apart. The urging of the pressurized fluid on the opposite edges forces the cam follower edge 34 of section 30 and section 32 against their respective face cam 18 so that the cam follower edge on each side of the vane 29 is in contact with its respective face cam. Leakage around one or the other cam follower edge 34, which is normally encountered with solid vanes, is substantially reduced without the necessity of seals or structural changes to the housing in order to avoid such leakage.

It will be apparent that at the beginning of operation of the axial vane rotary device contact between the cam follower edges 34 of the vane sections will be minimal until sufficient pressure is produced to urge the sections axially apart so to bring both cam follower edges of the split vane into contact with the face cams 18 of the end walls 17. Referring to FIG. 3 a pair of spring members 38 are mounted in sockets 40 formed in the opposite edges of vane sections 30 and 32. The spring members 38 are under compression to urge the vane section 30 and 32 axially away from each other and are held under compression by the contact of the cam follower edges 34 against their respective face cams 18. In this manner intimate contact between the cam follower edges 34 and the face cams 18 is continuous even when the axial vane rotary device is not in operation and leakage is kept to a minimum during startup of the device and when operating at low outlet pressures. While a pair of spring members 38 is shown, it will be apparent that a single spring member may be used with beneficial results and more than two spring members are highly useful when operating at low pressure to insure intimate contact by the cam follower edges 34.

As mentioned above, another source of leakage can occur between the radially inner end 26 of the vanes 14 and the fixed inner housing 22. During rotation centrifugal force urges the vanes 14 radially outwardly into contact with the inner face of the fixed outer housing 24. This produces an area between the radially inner ends 26 of the vanes 14 and the fixed inner housing 22 through which pressurized fluid can leak during operation of an axial vane rotary device.

Figure 5:
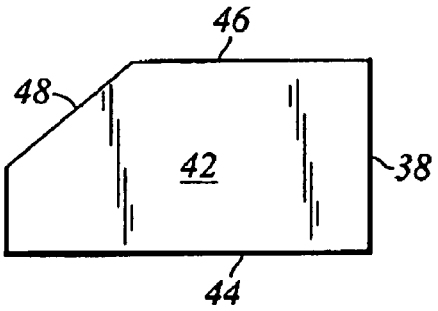
FIG. 5 is a side elevation of an inner housing seal piece of FIG. 4.

Referring to FIG. 4 and FIG. 5, the split vane 29 of the invention comprises two sections, 30 and 32. An independent inner housing seal piece 42 is provided for each of the sections 30 and 32 of the split vane 29. The independent inner housing seal pieces 42 form part of the radially inner end 26 of the vane 29 and are adapted to move radially downwardly independently of a respective one of vane sections 30 and 32 to intimately contact the fixed inner housing 22. Preferably the inner housing seal pieces 42 are formed by the portion of the vane section 30 and 32 defined at the intersection of the opposite edge 36 and the radially inner end 26 at the corner each of the vane sections 30 and 32. Each of the seal pieces 42 define a generally straight lower edge 44, an upper edge 46, a camming surface 48 which is biased downwardly in the direction of the cam follower edge 34 and an inner edge 45. The corresponding one of sections 30 and 32 include a correspondingly configured edge 50 that abuts upper edge 46 of the corresponding inner housing seal piece 42. The sections 30 and 32 also include a corresponding sloped portion 51 that abuts the camming surface 48 of the upper edge and an edge portion corresponding to the inner edge 45 of the inner housing seal piece.

During operation pressurized fluid acting on the opposite edges 36 of the split vane 29 to move the sections 30 and 32 axially apart as described above also urges the inner housing seal piece 42 axially causing it to move downwardly as a result of the camming action of the camming surface 48 acting against the corresponding sloped portion 51 of the correspondingly configured edge 50 of the split vane. This action forces the lower edge 44 of the inner housing seal piece 42 into intimate contact with the inner housing 22 to provide a sealing function between the split vane 29 and the inner housing.

In the embodiment illustrated in FIG. 4 a spring member 38 is located between the inner housing seal piece 42 of section 30 and the inner housing seal piece 42 of section 32. As described above in connection with the location of the spring member 38 between the sections 30 and 32, the spring member is under compression and urges the inner housing seal pieces axially for downward camming as described so that the lower edges 44 are in contact with the fixed inner housing 22 even when the axial vane radial device is operating at low pressure or is inoperative. It will be understood that the spring member 38 is not critical and that the inner housing seal pieces 42 will function as described by the urging of pressurized fluid.

Figure 6:
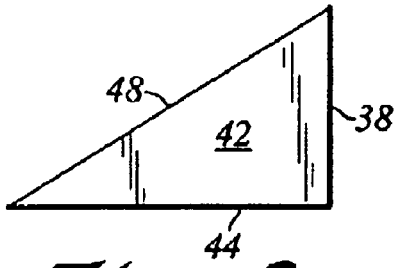
FIG. 6 is a side elevation of another embodiment of an inner housing seal piece.

Referring to FIG. 6 another embodiment of an inner housing seal piece 42 is shown. In this embodiment the inner housing seal piece 42 describes a right triangle with its hypotenuse defining the camming surface 48 of the inner housing seal piece. It will be apparent that other shapes can be used, it being critical only its upper edge 46 and the corresponding end of the vane section contain a sloped portion for translating the axial direction imparted to the inner housing seal piece by the pressurized fluid and/or spring member 38 to a downward motion for intimate contact by the lower edge of the inner housing seal piece with the fixed inner housing 22.

Figure 7:
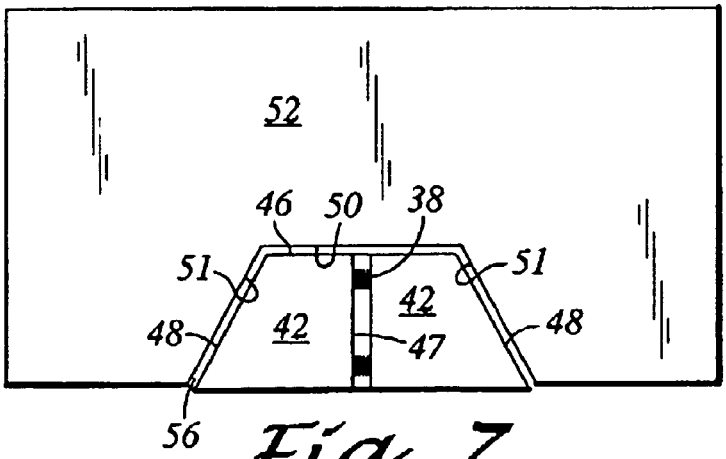
FIG. 7 is a side elevation of a solid vane provided with inner housing seal pieces.

It will be understood that solid vanes can also be adapted for the provision of inner housing seal pieces 42 to effect sealing between the vane and the fixed inner housing 42. Referring to FIG. 7 were like reference numbers denote like parts and like functions, a medial portion of a solid vane 52 is cut away to define a space for a pair of the inner housing sealing members 42. The members 42 are configured as described above and include a lower edge 44, an upper edge 46 and a camming surface 48. As described above the inner housing seal pieces 42 are mirror images to one another and are independently axially movable with respect to the vane 52 and to each other. The cut away portion defines a correspondingly configured edge 50 that cooperates with the camming surface 48 of the inner housing seal pieces 42 to urge the inner housing seal pieces downwardly responsive to their axial movement. Although not critical to their operation, one or more spring members 38 may be disposed between the inner housing seal pieces 42 to function in the manner and for the purpose described above when the rotary device is operating at low-pressure. In this manner sealing elements between the vane 52 and the fixed inner housing 22 can be eliminated even when using conventional single piece vanes.

As will be understood by those skilled in the art, various arrangements which lie within the spirit and scope of the invention other than those described in detail in the specification will occur to those persons skilled in the art. It is therefore to be understood that the invention is to be limited only by the claims appended hereto.

I claim:

1. In an axial vane rotary device including a stator with a cylindrical internal chamber defined by an stationary annular outer housing, two end walls closing the outer housing at each end thereof, the inner faces of the end walls define inwardly facing cam surfaces, an inner housing, a rotor, a driveshaft therefor journaled in the inner housing, the rotor being provided with at least a pair of angularly spaced apart axial slots in each of which is slideably disposed an improved vane having a radially outer end and an inner end and side edges, the invention comprising:

said improved vane comprising a pair of independent opposed sections, the side edges of each said section comprising a cam follower edge and an opposite edge, said cam follower edge being juxtaposed to the cam surface of an adjacent end wall, each of said sections being independently axially movable with respect to said other section, at least one spring member under compression disposed between said sections to normally urge said sections axially away from one another, each said section further including an inner housing seal piece independently radially downwardly movable with respect to said section, said inner housing seal piece defining a lower edge and an upper edge, said lower edge being in sealing contact with said inner housing when said inner housing seal piece is radially downwardly moved.

2. The improved vane of claim 1 wherein said upper edge of said inner housing seal piece is adapted to urge the radially downward movement of said inner housing seal piece thereby to bring said lower edge into contact with said inner housing.

3. The improved vane of claim 1 wherein said section of said vane includes a cutaway portion to define a space for receiving said inner housing seal piece, said section at said cutaway portion defining a lower edge corresponding with said upper edge of said inner housing seal piece.

4. The improved vane of claim 3 wherein at least a portion of said upper edge of said inner housing seal piece is biased downwardly in the direction of the cam follower edge of said section, said biased portion of said upper edge defining a camming surface that is contiguous with a correspondingly biased portion of said vane, whereby axial urging of said inner housing seal pieces produces a camming action to urge said inner housing seal piece downwardly to bring said lower edge of said inner housing seal piece into contact with said inner housing to provide an improved seal between said lower edge and said inner housing.

5. The improved vane of claim 3 wherein said inner housing seal piece defines a right triangle and the hypotenuse of said right triangle defines a camming surface that cooperates with a corresponding edge of said section of said vane to urge said inner housing seal piece downwardly upon axial movement thereof to provide an improved seal between said lower edge and said inner housing.

6. The improved vane of claim 1 wherein said inner housing seal piece forms a corner portion of said vane section defined in part by the intersection of said opposite edge and said radially inner end of said vane section.

7. The improved vane of claim 1 wherein said inner housing seal pieces of each pair of vane sections are mirror images of one another and are oppositely axially movable.

8. In an axial vane rotary device including a stator with a cylindrical internal chamber defined by an stationary annular outer housing, two end walls closing the outer housing at each end thereof, the inner faces of the end walls define inwardly facing cam surfaces, an inner housing, a rotor, a driveshaft therefor journaled in the inner housing, the rotor being provided with at least a pair of angularly spaced apart axial slots in each of which is slideably disposed an improved vane having a radially outer end and an inner end and side edges, the invention comprising:

said improved vane comprising a pair of independent opposed sections, the side edges of each said section comprising a cam follower edge and an opposite edge, said cam follower edge being juxtaposed to the cam surface of an adjacent end wall, each of said sections being independently axially movable with respect to said other section, at least one spring member under compression disposed between said sections to normally urge said sections axially away from one another, each said section further including an inner housing seal piece independently radially downwardly movable with respect to said section, said inner housing seal piece defining a lower edge and an upper edge, said lower edge being in sealing contact with said inner housing when said inner housing seal piece is radially downwardly moved, at least one spring member being disposed between said inner housing seal pieces of corresponding opposed sections to normally urge said inner housing seal pieces axially apart.

* * * * *